US005992525A

United States Patent [19]

Williamson et al.

[11] Patent Number: 5,992,525

[45] Date of Patent: Nov. 30, 1999

[54] APPARATUS AND METHODS FOR DEPLOYING TOOLS IN MULTILATERAL WELLS

[75] Inventors: Jimmie R. Williamson, Carrollton; James A. Woodcock, Flower Mound, both of Tex.

[73] Assignee: Halliburton Energy Services, Inc., Dallas, Tex.

[21] Appl. No.: 09/005,245

[22] Filed: Jan. 9, 1998

[51] Int. Cl.[6] ..... F21B 23/02; F21B 23/03; F21B 23/12

[52] U.S. Cl. ..... 166/313; 166/50; 166/380

[58] Field of Search ..... 166/50, 117.5, 166/117.6, 313, 380

[56] References Cited

U.S. PATENT DOCUMENTS

| | | | |
|---|---|---|---|
| 2,397,070 | 3/1946 | Zublin . | |
| 2,452,920 | 11/1948 | Gilbert . | |
| 2,797,893 | 7/1957 | McCune et al. . | |
| 2,858,107 | 10/1958 | Colmerauer . | |
| 4,133,378 | 1/1979 | Gano | 166/313 X |
| 4,396,075 | 8/1983 | Wood et al. | 175/79 |
| 4,402,551 | 9/1983 | Wood et al. | 299/5 |
| 4,415,205 | 11/1983 | Rehm et al. | 299/5 |
| 4,444,276 | 4/1984 | Peterson, Jr. | 175/61 |
| 4,573,541 | 3/1986 | Josse et al. | 175/78 |
| 4,807,704 | 2/1989 | Hsu et al. | 166/313 |
| 4,915,172 | 4/1990 | Donovan et al. | 166/50 X |
| 5,318,122 | 6/1994 | Murray et al. | 166/313 |
| 5,353,876 | 10/1994 | Curington et al. | 166/313 |
| 5,388,648 | 2/1995 | Jordan, Jr. | 166/380 |
| 5,501,281 | 3/1996 | White et al. | 166/387 |
| 5,520,252 | 5/1996 | McNair | 166/313 |
| 5,564,503 | 10/1996 | Longbottom et al. | 166/313 |
| 5,566,763 | 10/1996 | Williamson et al. | 166/382 |
| 5,595,247 | 1/1997 | Braddick | 166/117.6 X |
| 5,613,559 | 3/1997 | Williamson et al. | 166/381 |
| 5,730,224 | 3/1998 | Williamson et al. | 166/50 X |
| 5,769,167 | 6/1998 | Braddick | 166/117.6 |
| 5,813,465 | 9/1998 | Terrell et al. | 166/50 X |

FOREIGN PATENT DOCUMENTS 2 282 835 4/1995 United Kingdom .

*Primary Examiner*—George Suchfield
*Attorney, Agent, or Firm*—Paul I. Herman; W. David Lee

[57] ABSTRACT

Improved apparatus and methods for deploying tools in multilateral wells are disclosed. Certain ones of the apparatus and methods include a downhole tool centralizer assembly for coupling to a downhole tool. The centralizer assembly has a tubular centralizer retainer with an external surface and an annular recess on the external surface. An annular spring member is disposed within the annular recess, and the annular spring member has an outer diameter greater than a predetermined inner diameter of a bushing disposed proximate a junction between a main wellbore and a lateral wellbore. Other ones of the apparatus and methods include a downhole tool having a substantially identical tubular centralizer retainer and annular spring member. As the centralizer assembly, or the downhole tool, enters the bushing, the annular spring member elastically deforms so that the outer diameter of the spring member becomes substantially equal to the predetermined inner diameter of the bushing. Such elastic deformation prevents the centralizer assembly, or the downhole tool, from accidentally entering the lateral wellbore.

32 Claims, 13 Drawing Sheets

APPARATUS AND METHODS FOR DEPLOYING TOOLS IN MULTILATERAL WELLS

RELATED APPLICATIONS

This application is related to concurrently filed U.S. application Ser. No. 09/005,246, filed on Jan. 9, 1998 entitled "Apparatus and Methods for Deploying Tools in Multilateral Wells" which is commonly assigned with the present invention and is incorporated herein by reference.

FIELD OF THE INVENTION

The present invention pertains to the completion of and production from lateral wellbores, and, more particularly, but not by way of limitation, to improved apparatus and methods for deploying tools in wells having such lateral wellbores.

HISTORY OF THE RELATED ART

Horizontal well drilling and production have become increasingly important to the oil industry in recent years. While horizontal wells have been known for many years, only relatively recently have such wells been determined to be a cost-effective alternative to conventional vertical well drilling. Although drilling a horizontal well costs substantially more that its vertical counterpart, a horizontal well frequently improves production by a factor of five, ten, or even twenty in naturally-fractured reservoirs. Generally, projected productivity from a horizontal wellbore must triple that of a vertical wellbore for horizontal drilling to be economical. This increased production minimizes the number of platforms, cutting investment, and operation costs. Horizontal drilling makes reservoirs in urban areas, permafrost zones, and deep offshore waters more accessible. Other applications for horizontal wellbores include periphery wells, thin reservoirs that would require too many vertical wellbores, and reservoirs with coning problems in which a horizontal wellbore could be optimally distanced from the fluid contact.

Some horizontal wellbores contain additional wellbores extending laterally from the primary vertical wellbore. These additional lateral wellbores are sometimes referred to as drainholes, and vertical wellbores containing more than one lateral wellbore are referred to as multilateral wells. Multilateral wells allow an increase in the amount and rate of production by increasing the surface area of the wellbore in contact with the reservoir. Thus, multilateral wells are becoming increasingly important, both from the standpoint of new drilling operations and from the reworking of existing wellbores, including remedial and stimulation work.

As a result of the foregoing increased dependence on and importance of horizontal wells, horizontal well completion, and particularly multilateral well completion, have been important concerns and continue to provide a host of difficult problems to overcome. Lateral completion, particularly at the juncture between the main and lateral wellbores, is extremely important to avoid collapse of the wellbore in unconsolidated or weakly consolidated formations. Thus, open hole completions are limited to competent rock formations; and, even then, open hole completions are inadequate since there is no control or ability to access (or reenter the lateral) or to isolate production zones within the wellbore. Coupled with this need to complete lateral wellbores is the growing desire to maintain the lateral wellbore size as close as possible to the size of the primary vertical wellbore for ease of drilling and completion. Conventionally, horizontal wells have been completed using open hole techniques, slotted or perforated liners, external casing packers, and cementing and perforating techniques.

The problem of lateral wellbore (and particularly multilateral wellbore) completion has been recognized for many years, as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g. accessing) a lateral subsequent to completion thereof. U.S. Pat. Nos. 4,396,075; 4,415,205; 4,444,276; and 4,573,541 all relate generally to methods and devices for multilateral completions using a template or tube guide head. Other patents of general interest in the field of horizontal well completion include U.S. Pat. Nos. 2,452,920 and 4,402,551.

More recently, U.S. Pat. Nos. 5,318,122; 5,353,876; 5,388,648; and 5,520,252 have disclosed methods and apparatus for sealing the juncture between a vertical well and one or more horizontal wells. In addition, U.S. Pat. No. 5,564,503, which is commonly assigned with the present invention and is incorporated herein by reference, discloses several methods and systems for drilling and completing multilateral wells. Furthermore, U.S. Pat. Nos. 5,566,763 and 5,613,559, which are commonly assigned with the present invention and are incorporated herein by reference, both disclose decentralizing, centralizing, locating, and orienting apparatus and methods for multilateral well drilling and completion.

Notwithstanding the above-described efforts toward obtaining cost-effective and workable lateral well drilling and completions, a need still exists for improved apparatus and methods for deploying tools in multilateral wells. Toward this end, there also remains a need to increase the economy in lateral well drilling and completions, such as, for example, by minimizing the number of downhole trips necessary to drill and complete a lateral wellbore.

During the completion of or production from a multilateral well, it is often necessary to reenter a selected one of the lateral wellbores to perform completion work, additional drilling, or remedial or stimulation work. Such operations are typically performed using a variety of running tools, pulling tools, and wire-line tools. As these tools reach a junction between the main wellbore and a lateral wellbore in a multilateral well, the tool must be capable of being deployed into the present lateral wellbore or being navigated past the present lateral wellbore, through the main wellbore, and to a junction with a lower lateral wellbore. For this reason, analysis is typically performed on portions of the main wellbore considered for a junction to insure that the orientation of the main wellbore will assist in preventing unwanted deployment of the tool into the lateral wellbore. As shown in FIG. 1, junction 10 between lateral wellbore 14 and main wellbore casing 12 is such a junction. As wellbore casing 12 is angled in a first direction away from "true vertical" line 20, and as lateral wellbore 14 is angled in an opposite direction from "true vertical"line 20, gravity will naturally assist in preventing unwanted deployment of a tool into lateral wellbore 14.

However, tool deployment and navigation is particularly difficult in multilateral wells in which junctions must be located in a portion of the main wellbore that is truly vertical (FIG. 2) or "upside down" (FIG. 3). In FIG. 2, even though wellbore casing 12 has a center line generally coincident with "true vertical" line 20, a dogleg in wellbore casing 12 or a protrusion into wellbore casing 12 above junction 10 may cause unwanted deployment of a tool into lateral wellbore 14. In FIG. 3, as wellbore casing 12 is angled away from "true vertical" line in generally the same direction as lateral wellbore 14, gravity is likely to cause the unwanted deployment of a tool into lateral wellbore 14.

Such unwanted deployment has conventionally been addressed in two ways. First, it is known to use a smaller diameter lateral wellbore 14, relative to the diameter of the main wellbore casing 12, to form junction 10. In this way, a tool with a diameter larger than that of lateral wellbore 14 will not be accidentally deployed into lateral wellbore 14 due to doglegs, protrusions, or gravitational forces. However, such smaller diameter lateral wellbores lower the amount and rate of production of the multilateral well and are more difficult to complete. In addition, additional downhole tools with smaller diameters are required to access lateral wellbore 14.

Second, such unwanted deployment has also been addressed using a rotatable deflector positioned proximate junction 10. Such rotatable deflectors may be moved to a first position, located in main wellbore casing 12, that deploys a tool into lateral wellbore 14. In addition, a downhole tool may be used to move the rotatable deflector to a second position, located in lateral wellbore 14, that prevents tool deployment into lateral wellbore 14 but allows further navigation of a tool down main well bore casing 12. However, such rotatable deflectors always require the use of a downhole tool or a hydraulic system for actuation between the above-described positions, and therefore increase the cost of completing and producing from a multilateral well.

SUMMARY OF THE INVENTION

The present invention is directed to improved apparatus and methods for deploying tools in wells having lateral wellbores, and particularly in multilateral wells having a plurality of junctions between a main wellbore and lateral wellbores. The present invention provides dependable, flexible navigation of such junctions without inhibiting the amount or rate of well production or increasing the cost or complexity of the completion of the lateral wellbore.

One aspect of the present invention comprises a downhole tool centralizer assembly for use in a bushing disposed proximate a junction between a main wellbore and a lateral wellbore. The centralizer assembly includes a tubular centralizer retainer having an external surface and an annular recess on the external surface. The centralizer assembly also includes a first sub for releasably coupling to a downhole tool, and an annular spring member disposed within the annular recess. The annular spring member has an outer diameter greater than a predetermined inner diameter of the bushing.

In another aspect, the present invention comprises a method of navigating a downhole tool through a junction between a main wellbore and a lateral wellbore. The junction has a main wellbore casing and a bushing disposed in the main wellbore casing. The bushing has a window proximate the lateral wellbore. A downhole tool centralizer assembly is provided. The centralizer assembly includes a tubular centralizer retainer having an external surface and an annular recess on the external surface. The centralizer assembly also includes an annular spring member disposed within the annular recess. The annular spring member has an outer diameter greater than a predetermined inner diameter of the bushing. A downhole tool is coupled to the downhole tool centralizer assembly, and the centralizer assembly and the downhole tool are moved through the bushing. As the centralizer assembly moves through the bushing, the annular spring member is elastically deformed so that its outer diameter becomes substantially equal to the predetermined inner diameter of the bushing.

In a further aspect, the present invention comprises a downhole tool for use in a bushing disposed proximate a junction between a main wellbore and a lateral wellbore. The downhole tool includes a tubular centralizer retainer having an external surface and an annular recess on the external surface, and an annular spring member disposed within the annular recess. The annular spring member has an outer diameter greater than a predetermined inner diameter of the bushing.

In a further aspect, the present invention comprises a method of navigating a downhole tool through a junction between a main wellbore and a lateral wellbore. The junction has a main wellbore casing and a bushing disposed in the main wellbore casing. The bushing has a window proximate the lateral wellbore. A downhole tool is formed including a tubular centralizer retainer having an external surface and an annular recess on the external surface, and an annular spring member disposed within the annular recess. The annular spring member has an outer diameter greater than a predetermined inner diameter of the bushing. The downhole tool is moved through the bushing. As the downhole tool is moved through the bushing, the annular spring member is elastically deformed so that the outer diameter of the annular spring member becomes substantially equal to the predetermined inner diameter of the bushing.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION OF THE PREFERRED EMBODIMENTS

Figure 1:
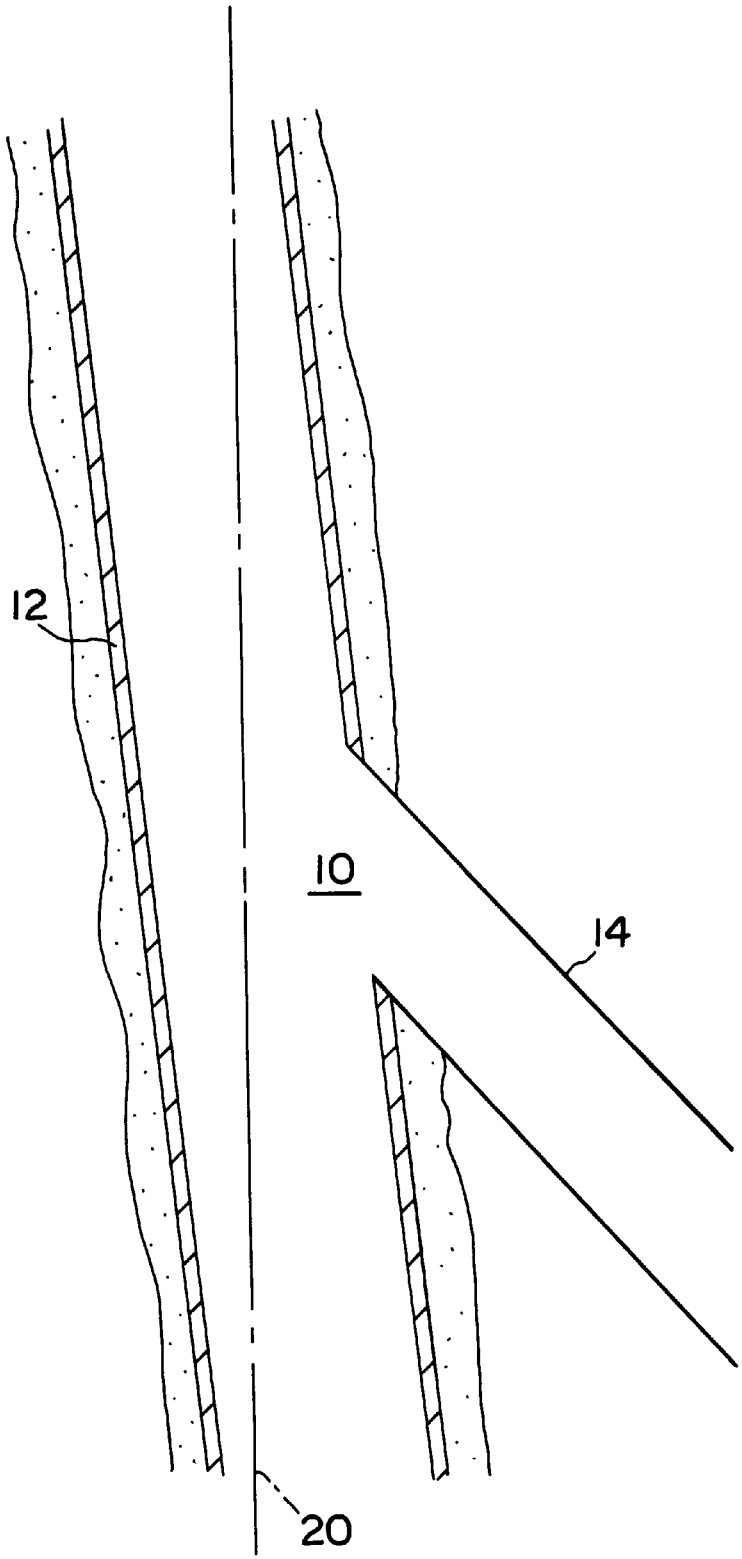
FIG. 1 is a schematic, cross-sectional view of a portion of a multilateral well including a junction between the main wellbore and a lateral wellbore.
Figure 2:
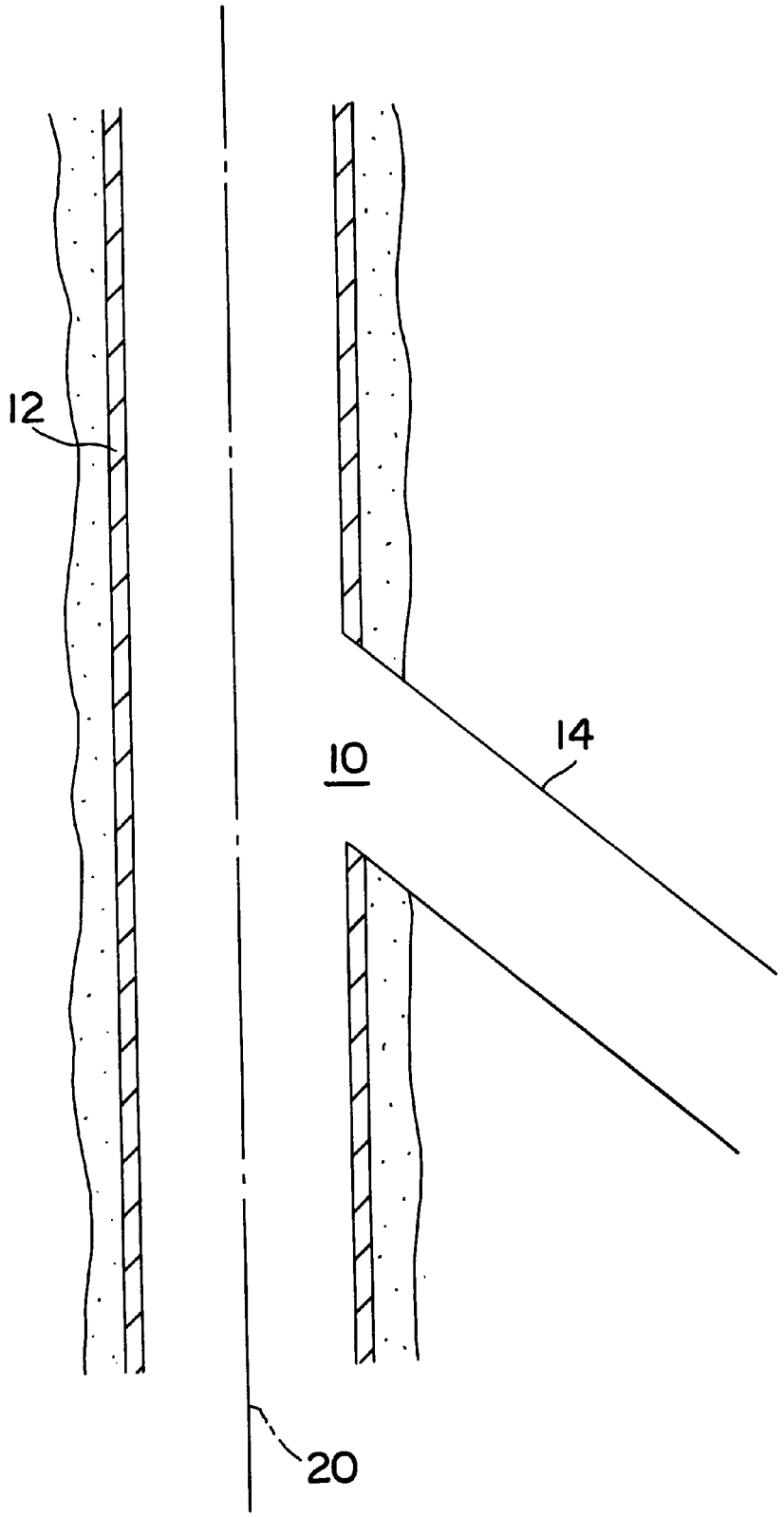
FIG. 2 is a schematic, cross-sectional view of a portion of a multilateral well including a second junction between the main wellbore and a lateral wellbore.
Figure 3:
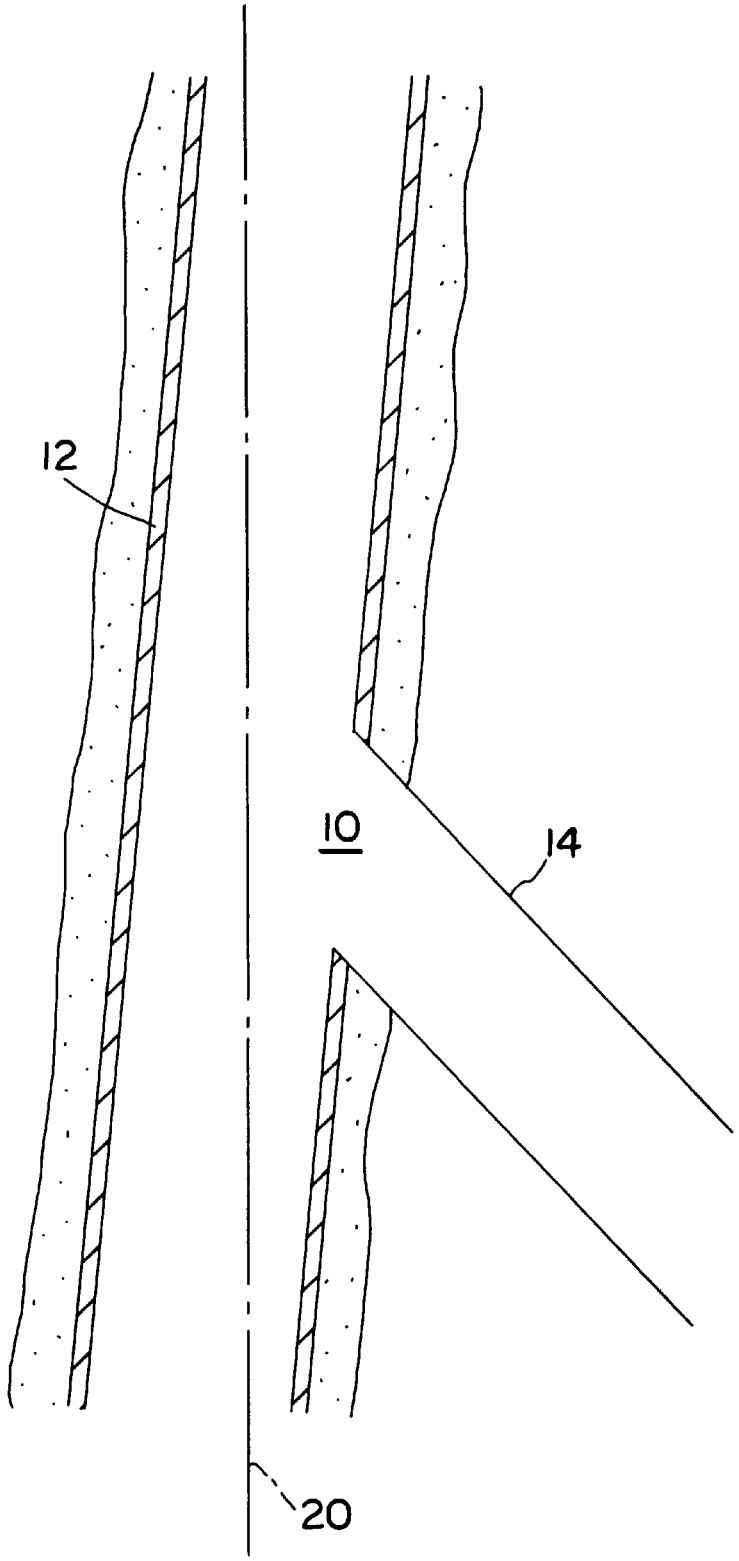
FIG. 3 is a schematic, cross-sectional view of a portion of a multilateral well including a third junction between the main wellbore and a lateral wellbore.

The preferred embodiments of the present invention and their advantages are best understood by referring to FIGS. 1–11 of the drawings, like numerals being used for like and corresponding parts of the various drawings. In accordance with the present invention, various apparatus and methods for deploying tools through a junction between the main wellbore and a lateral wellbore in a multilateral well are described. It will be appreciated that the terms "vertical", "horizontal", and "lateral" are used herein for convenience of illustration. The present invention may be employed in wells, or portions of wells, which extend in directions other than truly vertical or truly horizontal. For example, as shown in FIGS. 1–3, portions of a substantially vertical main wellbore may not be truly vertical. In addition, as also shown in FIGS. 1–3, portions of a substantially horizontal or lateral wellbore may not be truly horizontal. Furthermore, the main wellbore as a whole may not be truly vertical, and a lateral wellbore as a whole may not be truly horizontal. Therefore, unless otherwise indicated, the terms "main wellbore", "primary wellbore", and "vertical wellbore" as used herein refer to a substantially vertical wellbore, and the terms "lateral wellbore" or "horizontal wellbore" refer to a substantially horizontal wellbore.

In the overall process of drilling and completing a lateral in a multilateral well, the following general steps are performed. First, the main wellbore is drilled, and the main wellbore casing is installed and cemented into place. Once the desired location for a junction is identified, a window is then created in the main wellbore casing using an orientation device, a multilateral packer, a hollow whipstock, and a series of mills. Next, the lateral wellbore is drilled, and a liner is disposed in the lateral wellbore and cemented into place. A mill is then used to drill through any cement plug at the top of the hollow whipstock and any portion of the lateral wellbore liner extending into the main wellbore to reestablish a fluid communicating bore through the main wellbore. Finally, a window bushing is disposed within the main wellbore casing, the hollow whipstock, and the multilateral packer. The window bushing facilitates the navigation of downhole tools through the junction between the main wellbore and the lateral wellbore.

Figure 4:
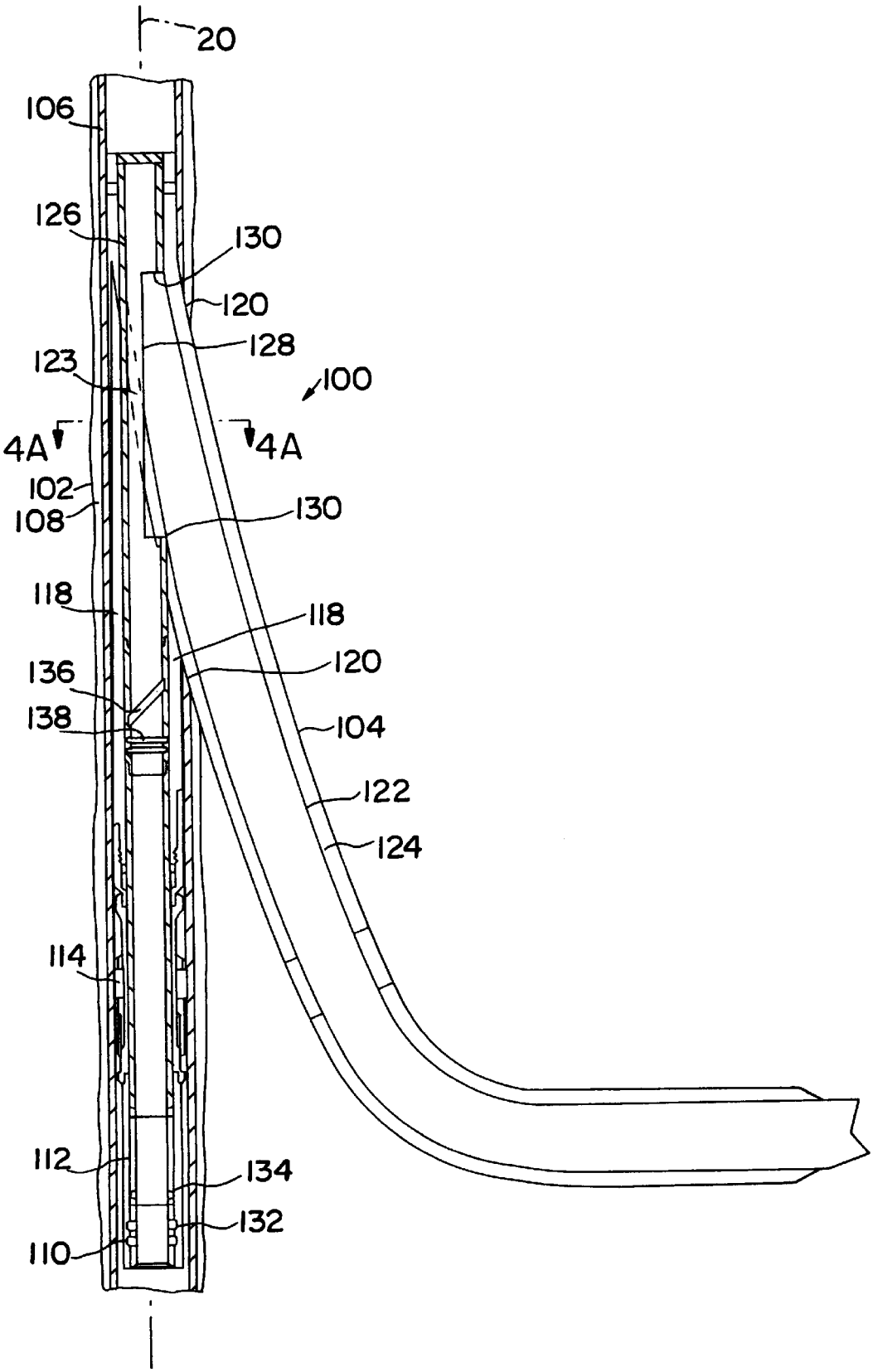
FIG. 4 is a schematic, cross-sectional view of a junction between the main wellbore and a lateral wellbore in a multilateral well showing a window bushing deployed at the junction.

Referring now to FIG. 4, an exemplary junction 100 between a main wellbore 102 and a lateral wellbore 104 is illustrated. Although main wellbore 102 is shown in FIG. 4 as substantially vertical, it may alternatively be angled away from "true vertical" line 20 in a direction generally opposite than lateral wellbore 104, similar to main wellbore casing 12 and lateral wellbore 14 in FIG. 1. In addition, main wellbore 102 may alternatively be angled away from "true vertical" line 20 is generally the same direction as lateral wellbore 104, similar to main wellbore casing 12 and lateral wellbore 14 in FIG. 3. Main wellbore 102 is drilled using conventional techniques. A main wellbore casing 106 is installed in main wellbore 102, and cement 108 is disposed between main wellbore 102 and main wellbore casing 106, using conventional techniques.

Once the desired location for junction 100 is identified, a shearable work string having a window bushing locating profile 110, an orientation nipple 112, a multilateral packer assembly 114, a hollow whipstock 118, and a starter mill pilot lug (not shown) is run into main wellbore casing 106. Certain portions of such a work string are more fully disclosed in U.S. Pat. Nos. 5,613,559; 5,566,763; and 5,501,281, which are commonly assigned with the present invention and are incorporated herein by reference. The work string is located at the proper depth and orientation within main wellbore casing 106 using conventional pipe tally and/or gamma ray surveys for depth and conventional measurement while drilling (MWD) orientation for azimuth. Packer assembly 114 is set against main wellbore casing 106 using slips, packing elements, and conventional hydraulic, mechanical, and/or electro-mechanical setting techniques.

Using techniques more completely described in the above-referenced U.S. Pat. Nos. 5,613,559; 5,566,763; and 5,501,281, whipstock 118 is used to guide work strings supporting a variety of tools and equipment to drill and complete lateral well bore 104. First, a series of mills, such as a starter mill, a window mill, and a watermelon mill, are used to create a window 120 in main wellbore casing 106. Next, a drilling motor is used to drill lateral wellbore 104 from window 120. A lateral wellbore liner 122 is then disposed within later wellbore 104, and cement or sealant 124 is disposed between lateral wellbore 104 and liner 122. A mill is then used to drill through any cement plug at the top of whipstock 118 and any portion of liner 122 extending into main wellbore casing 106, creating a generally elliptical opening 123. Opening 123 reestablishes a fluid communicating bore through main wellbore casing 106.

Opening 123 within main wellbore casing 106 often has relatively sharp or jagged edges. Therefore, a work string having a window bushing 126 is run into main wellbore casing 106, hollow whipstock 118, multilateral packer assembly 114, orientation nipple 112, and window bushing locating profile 110. Window bushing 126 has a window 128 that provides a known surface to guide downhole tools into liner 122 during subsequent completion or production operations within lateral wellbore 104. Window 128 preferably has smooth, beveled edges 130 that protect a downhole tool as it passes by opening 123. Window bushing 126 has a lock 132 at its lower end for mating with window bushing locating profile 110 to releasably secure window 128 at the proper depth with respect to window 120. Window bushing 126 has a second lock 134 for mating with orientation nipple 112 to releasably secure window 128 at the proper rotational orientation with respect to window 120. Window bushing 126 further includes a deflector orientation nipple 136 and a deflector locating profile 138.

Figure 4A:
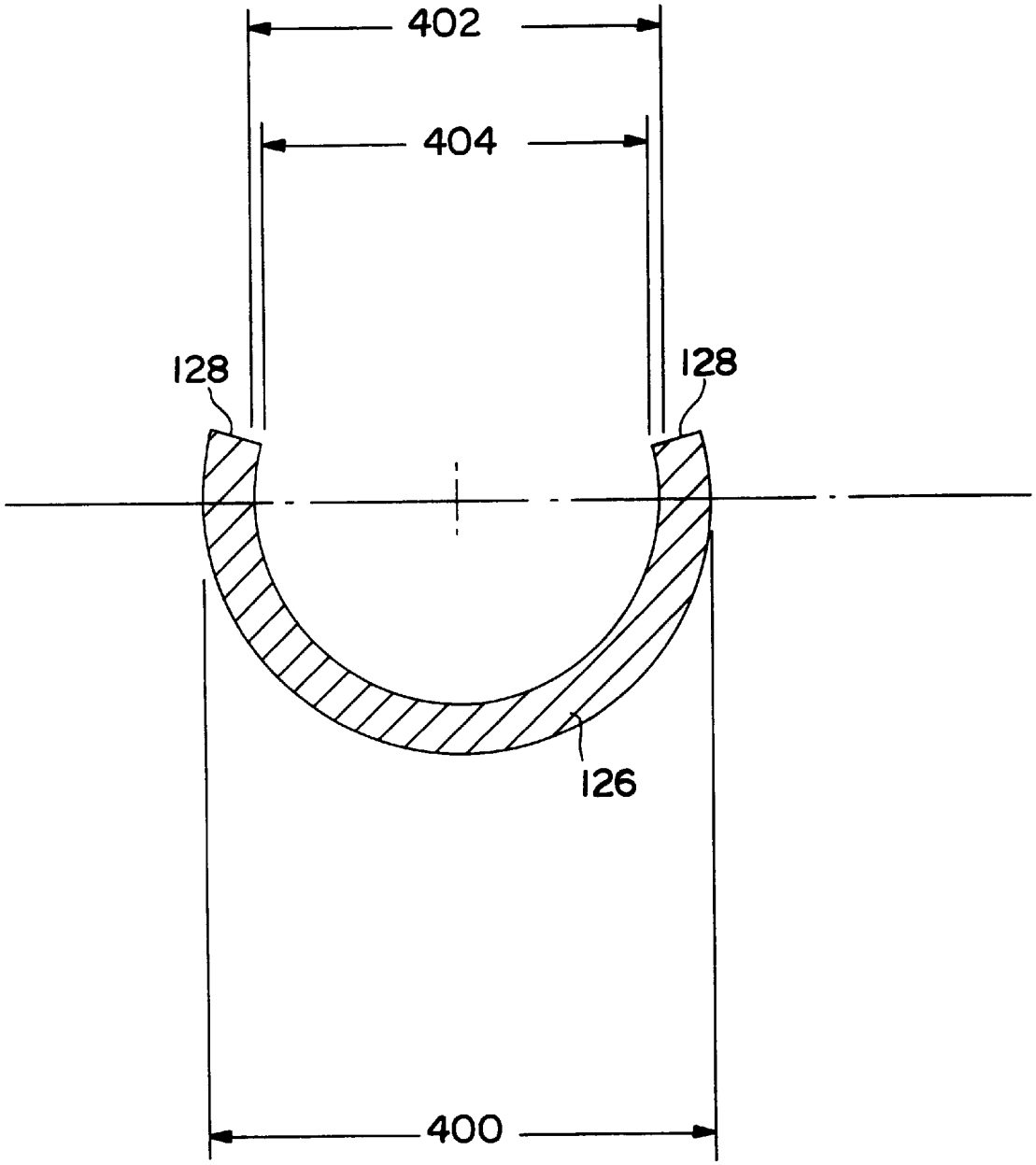
FIG. 4A is an enlarged, schematic, top sectional view of the window bushing of FIG. 4 along line 4A—4A with certain structures within the junction not shown for clarity of illustration.

As shown best in FIG. 4A, window bushing 126 has an outer diameter 400 that fits within the inner diameter of main wellbore casing 106 (not shown). Window bushing 126 also has an inner diameter 402. Window 128 of window bushing 126 has a width 404 slightly less than inner diameter 402, to prevent downhole tools from always falling out window 128 into liner 122 of lateral wellbore 104. Window bushing 126 may be the window bushing disclosed in the above-referenced U.S. Pat. Nos. 5,613,559 and 5,566,763.

Figure 5:
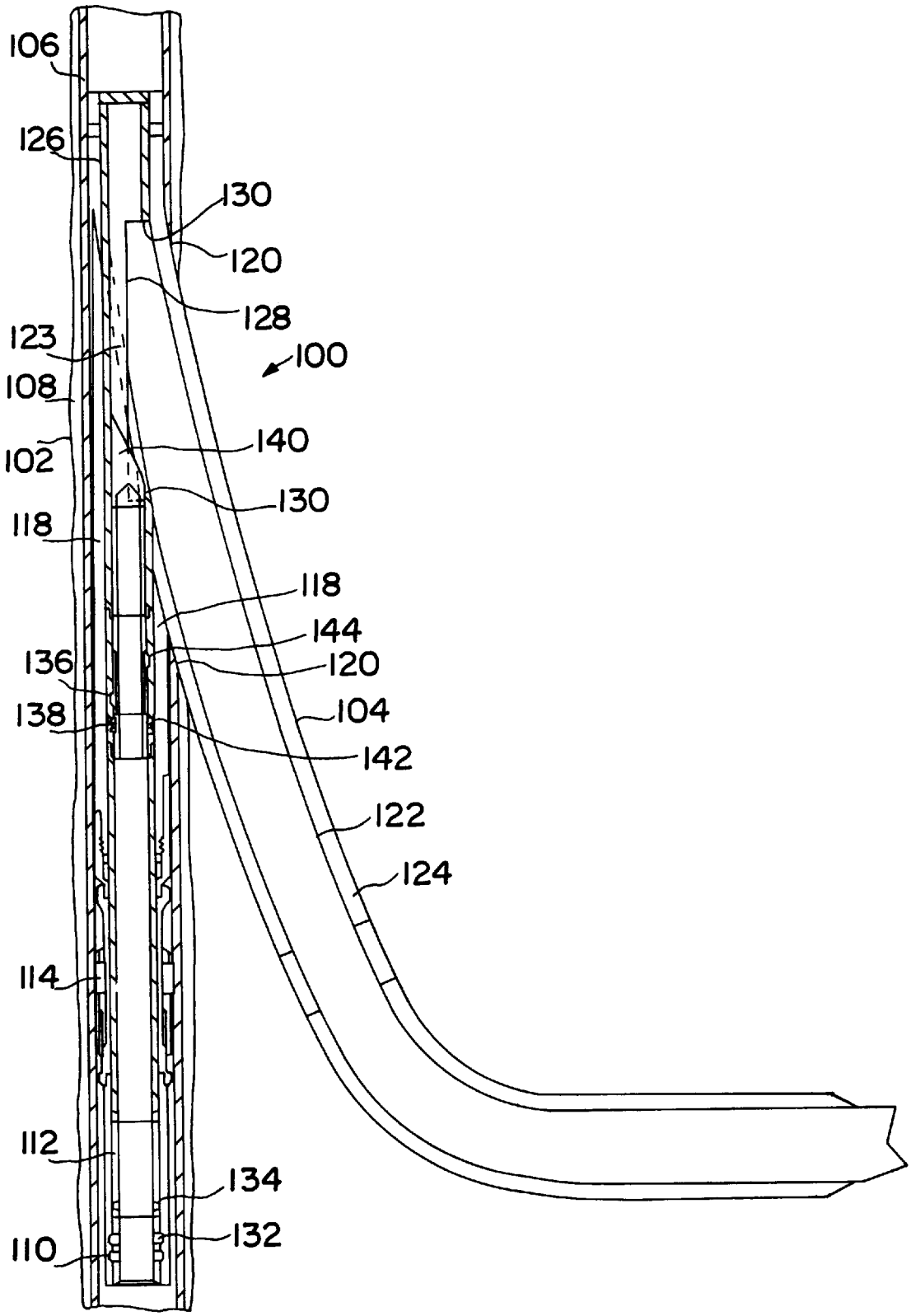
FIG. 5 is a schematic view of FIG. 4 with a deflector deployed within the window bushing for diverting a downhole tool into the lateral wellbore.

Using window bushing 126 as shown in FIG. 4, a work string having a conventional downhole tool traveling down through window bushing 126 will typically continue past window 128, unless a dogleg or other protrusion within main wellbore casing 106 above window bushing 126, or gravitational forces caused by the orientation of main wellbore 102, causes the downhole tool to accidentally fall out window 128 into liner 122. Conversely, if it is desired that such a conventional downhole tool enter liner 122 through window 128, a through tubing deflector must first be run into window bushing 126. Referring now to FIG. 5, a work string or coiled tubing having a conventional running tool has been used to dispose a through tubing deflector 140 into window bushing 126. Deflector 140 has first lock 142 for mating with deflector locating profile 138 of window bushing 126 to releasably secure deflector 140 at the proper depth with respect to window 128. Deflector 140 also has a second lock 144 for mating with deflector orientation nipple 136 of window bushing 126 to releasably secure deflector 140 at the proper rotational orientation with respect to window 128. Of course, a work string or coiled tubing having a conventional pulling tool may be used to remove deflector 140 from window bushing 126 to provide access to main wellbore casing 106 below junction 100, after the desired operations are completed in liner 122.

Figure 6:
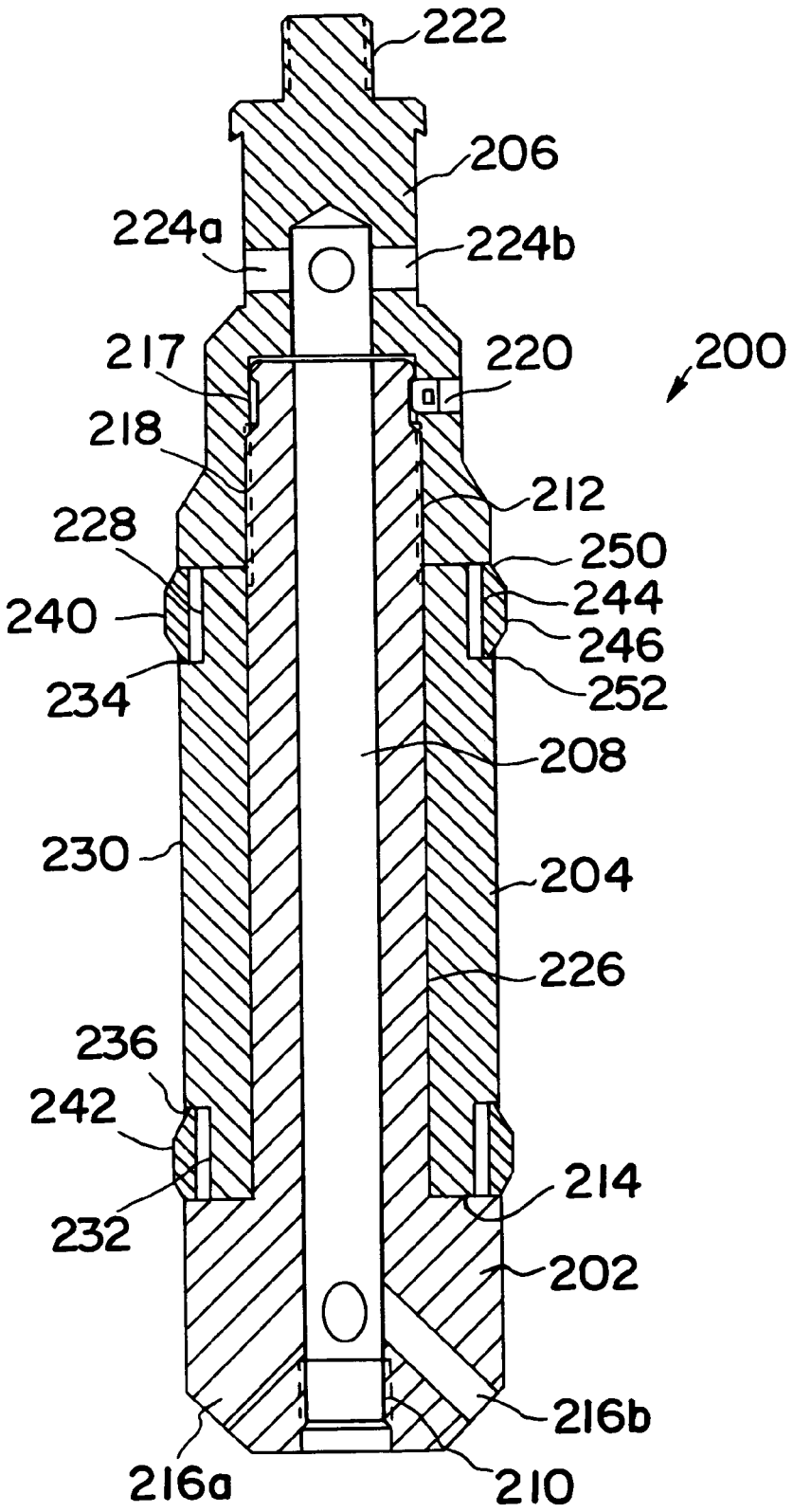
FIG. 6 is an enlarged, schematic, cross-sectional view of a wear ring centralizer assembly according to a preferred embodiment of the present invention for use in the window bushing of FIGS. 4 and 5.

Referring now to FIG. 6, a wear ring centralizer assembly 200 according to a first preferred embodiment of the present invention is illustrated. As is described in greater detail hereinbelow, wear ring centralizer assembly 200 is designed to help conventional downhole tools properly navigate through junction 100. Wear ring centralizer assembly 200 includes a bottom sub 202, a wear ring centralizer retainer 204, and a top sub 206. Wear ring centralizer assembly 200 also includes an axial bore 208 running between bottom sub 202 and top sub 206.

Bottom sub 202 includes threads 210 for releasably coupling with a pulling tool, a running tool, a wire-line tool, or other conventional downhole tool (not shown). Bottom sub 202 also includes threads 212 for releasably coupling with top sub 206, and an annular shoulder 214 for supporting wear ring centralizer retainer 204. Bottom sub 202 further includes fluid bypass ports 216*a* and 216*b* that are connected to axial bore 208.

Top sub 206 includes an axial bore 217 for receiving bottom sub 202, and threads 218 for mating with threads 212 of bottom sub 202. A set screw 220 preferably insures the integrity of this coupling. Top sub 206 also includes threads 222 for releasably coupling with a work string; a stem, a jar, a rope socket, and/or other conventional wire-line or coiled tubing coupling assemblies; or other conventional support string (not shown). Top sub 206 further includes fluid bypass ports 224*a* and 224*b* that are connected to axial bore 208.

Wear ring centralizer retainer 204 includes an axial bore 226 for receiving bottom sub 202, an annular recess 228 located on an exterior surface 230, and an annular recess 232 located on exterior surface 230. Annular recess 228 preferably has an annular retaining lip 234, and annular recess 232 preferably has an annular retaining lip 236. A wear ring centralizer 240 is disposed in annular recess 228, and a wear ring centralizer 242 is disposed in annular recess 232.

Figure 7A:
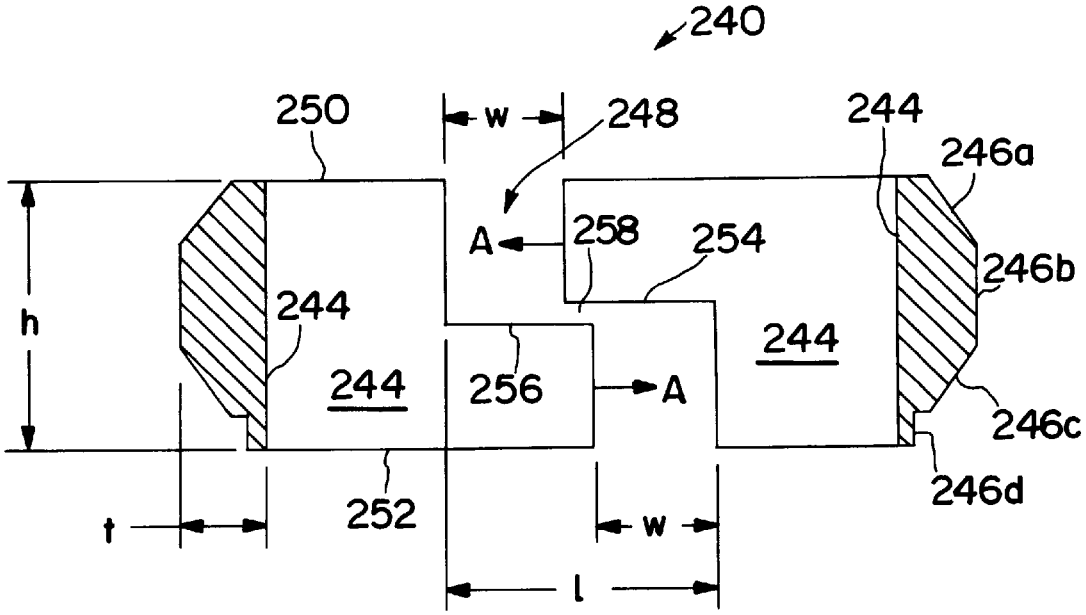
FIG. 7A is an enlarged, schematic, cross-sectional view of one of the wear ring centralizers of the wear ring centralizer assembly of FIG. 6.
Figure 7B:
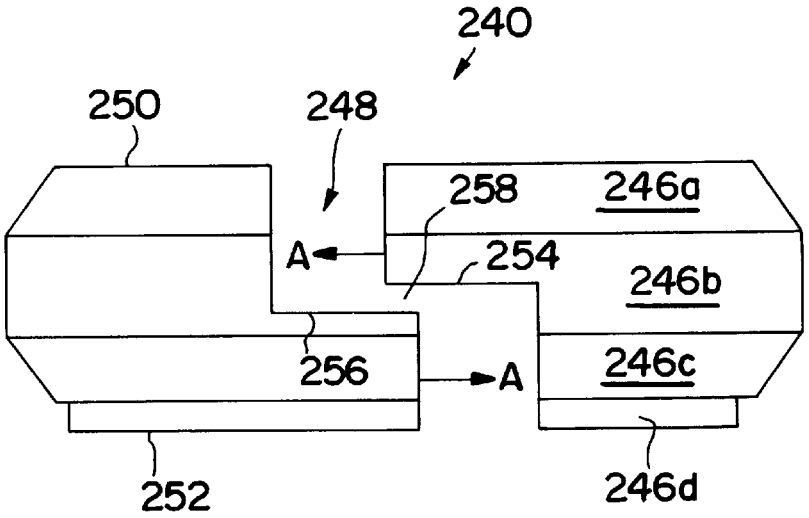
FIG. 7B is a schematic, external view of the wear ring centralizer of FIG. 7A.

Wear ring centralizer 240 preferably has a cylindrical axial bore 244 and a generally cylindrical external surface 246. As shown best in FIGS. 7A and 7B, external surface 246 preferably has a first angled portion 246*a*, a first flat portion 246*b*, a second angled portion 246*c*, and a second flat portion 246*d*. Second flat portion 246*d* engages annular retaining lip 234 of annular recess 228. Wear ring centralizer 240 also preferably includes a gap or cut 248 that travels between a top surface 250 and a bottom surface 252 of wear ring centralizer 240. Gap 248 also extends through the thickness of wear ring centralizer 240, from external surface 246 to axial bore 244. Gap 248 creates two slidably, mating surfaces 254 and 256. Wear ring centralizer 240 is formed from a spring steel capable of elastic deformation. Preferred materials for wear ring centralizer 240 include titanium alloys and 13 Chrome alloys. In addition, external surface 246 is preferably spray-welded with a wear coating such as tungsten carbide to resist wear caused by downhole use. As is explained in greater detail hereinbelow, the materials used for wear ring centralizer 240 and gap 248 combine to allow wear ring centralizer 240 to compress and expand radially. When wear ring centralizer 240 is in its undeformed position as shown in FIGS. 7A and 7B, mating surfaces 254 and 256 preferably overlap at a point 258.

Wear ring centralizer 242 is preferably formed with a substantially identical structure to, and using the same materials as, wear ring centralizer 240, As shown in FIG. 6, second flat portion 246*d* of wear ring centralizer 242 engages annular retaining lip 236 of annular recess 232.

Referring again to FIG. 6, wear ring centralizer retainer 204 is shown with two wear ring centralizers each disposed in a corresponding annular recess. Alternatively, wear ring centralizer retainer 204 may employ only one, or more than two, wear ring centralizers, each disposed in a corresponding annular recess. Still further in the alternative, although centralizers 240 and 242 have been described above as wear ring centralizers, it is contemplated that other annular members formed from a spring steel, steel alloy, or metal, including a garter spring, may be used for centralizers 240 and 242 in certain downhole applications.

Figure 8:
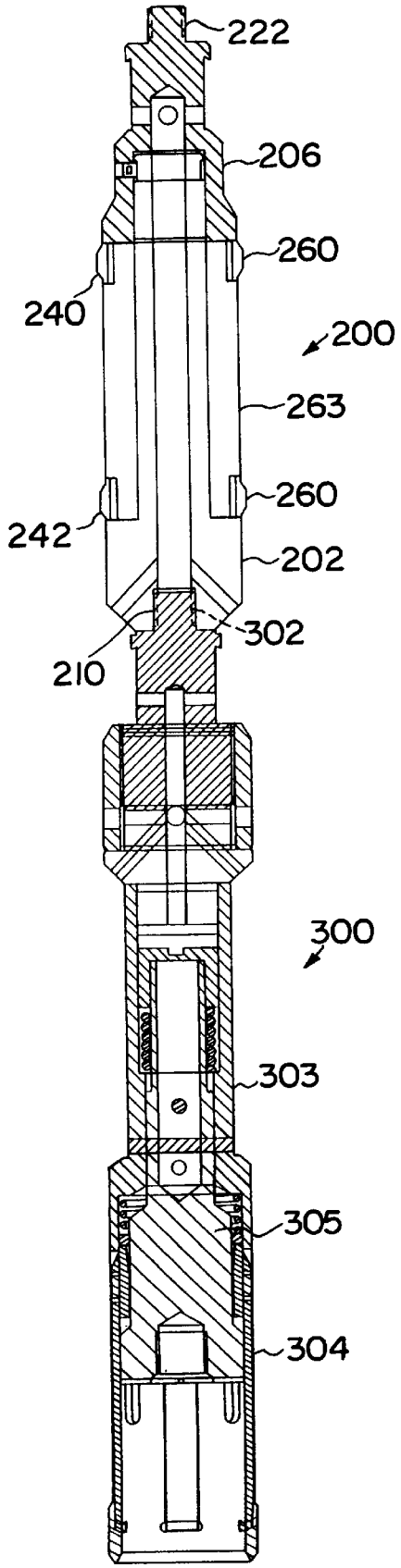
FIG. 8 is a schematic, cross-sectional view of the wear ring centralizer assembly of FIG. 6 operatively coupled to a conventional downhole tool.

Referring now to FIG. 8, wear ring centralizer assembly 200 is shown coupled to an exemplary, conventional downhole tool 300. As shown in FIG. 8, downhole tool 300 is a wire-line pulling tool typically used for pulling deflectors, plugs, or prongs. Downhole tool 300 has threads 302 for mating with threads 210 of bottom sub 202. Although not shown in FIG. 8, downhole tool 300 may be any conventional downhole tool, such as, for example, a running tool, a pulling tool, or a wire-line tool. As shown in FIG. 8, wear ring centralizer assembly 200 is preferably located at the bottom of a work string just behind downhole tool 300. Alternatively, although not shown in FIG. 8, when wear ring centralizer assembly 200 is used with a downhole tool not having operative parts on its front (or lower) end, such as a wire-line pressure recorder, wear ring centralizer assembly 200 may be located at the bottom of a work string just in front of such a downhole tool. In this configuration, threads 222 of top sub 206 would releasably couple with the corresponding threads of such a downhole tool. Downhole tool 300 has a maximum outer diameter 304 less than the outer diameter 260 of wear ring centralizers 240 and 242 in their undeformed state. Outer diameter 260 of wear ring centralizers 240 and 242 in their undeformed state is slightly greater than the inner diameter 402 of window bushing 126 (see FIG. 4A).

Figure 9:
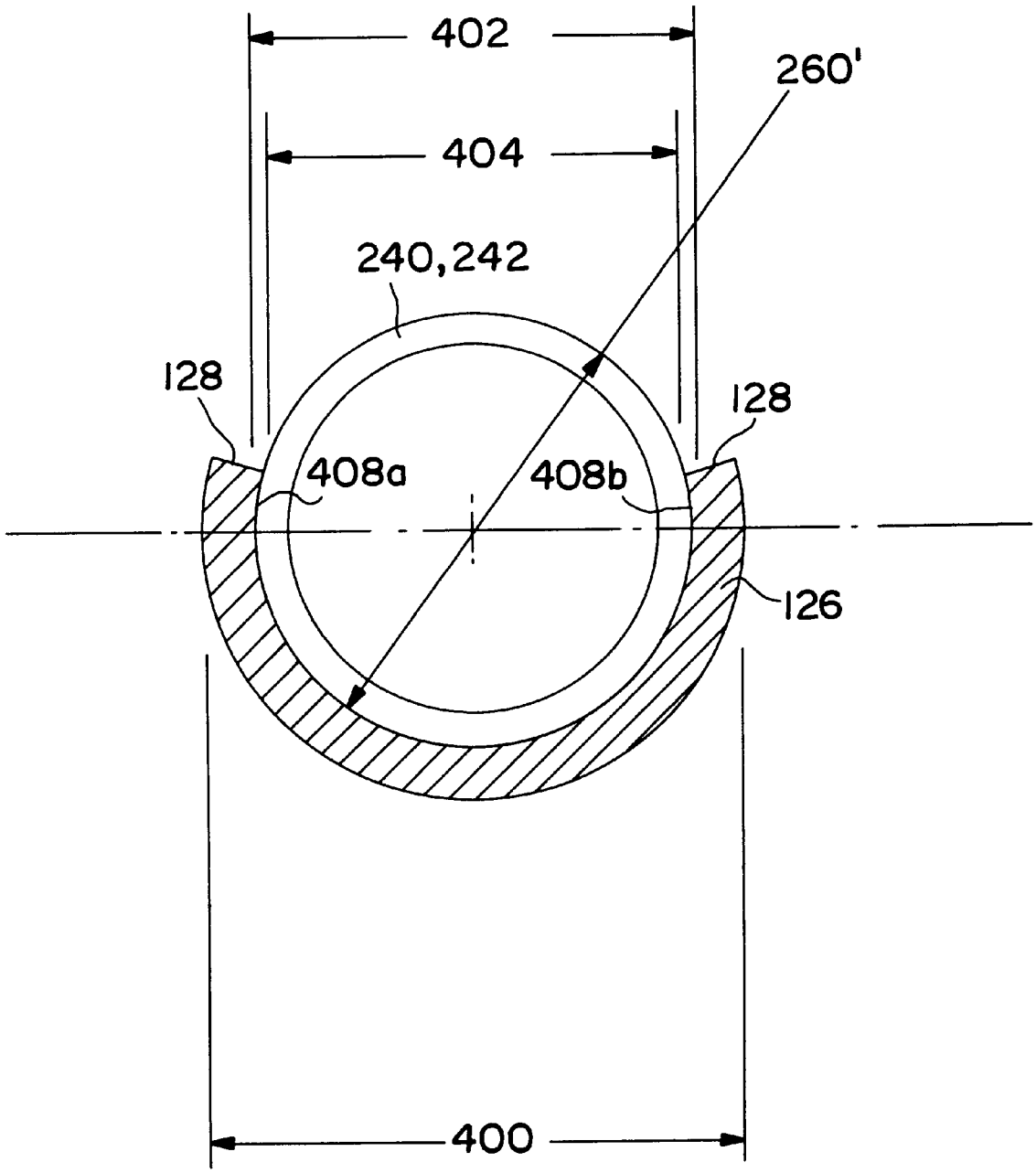
FIG. 9 is an enlarged, schematic, top sectional view of one of the wear ring centralizers of the wear ring centralizer assembly of FIG. 6 disposed within the window bushing of FIGS. 4 and 5 with certain structures within the junction not shown for clarity of illustration.

Referring now to FIGS. 4, 5, 6, 7A, 7B, 8, and 9 in combination, the use of wear ring centralizer assembly 200 coupled with conventional downhole tool 300 to navigate through junction 100 in a multilateral well will now be described in more detail. Referring first to FIG. 4, as a work string including downhole tool 300 and wear ring centralizer assembly 200 approaches the top of window bushing 126, downhole tool 300 enters window bushing 126 without contacting window bushing 126. However, as wear ring centralizer assembly 200 enters window bushing 126, wear ring centralizers 242 and 240 are radially compressed from their undeformed outer diameter 260 (FIG. 8) to their deformed outer diameter 260' (FIG. 9). Such compression occurs because undeformed outer diameter 260 of wear ring centralizers 242 and 240 is slightly greater than inner diameter 402 of window bushing 126, and because the wear ring centralizers elastically deform in the direction of arrows A in FIGS. 7A and 7B so as to narrow gap 248. As shown in FIG. 9, such compression creates an interference between window bushing 126 and wear ring centralizers 240 and 242 at least at regions 408*a* and 408*b*. This interference keeps downhole tool 300 from accidentally falling out window 128 into liner 122 due to a dogleg or other protrusion within main wellbore casing 106 above junction 100, or gravitational forces caused by the orientation of main wellbore 102. In addition, this interference allows wear ring centralizer assembly 200 to continue moving downward through window bushing 126. One should note that this interference preferably extends around the entire, circular area of potential contact between the window bushing 126 and wear ring centralizers 240 and 242. Such a complete, circular interference compensates for the rotation of downhole tool 300 and wear ring centralizer assembly 200 as they are suspended from a work-string or wire-line within window bushing 126. While such interference exists, fluid bypass ports 216*a*, 216*b*, 224*a*, and 224*b* and axial bore 208 allow fluid to recirculate up the annulus between window bushing 126 and the work string supporting downhole tool 300 and wear ring centralizer assembly 200. As wear ring centralizer assembly 200 exits from window bushing 126 below junction 100, wear ring centralizers 242 and 240 radially expand back to their undeformed diameter 260, reopening gap 248.

Of course, if it is desired that downhole tool 300 enter liner 122 of lateral wellbore 104, wear ring centralizer assembly 200 is not coupled to downhole tool 300. When it has been determined via a spinner survey or other conventional analysis that main wellbore 102 is angled away from "true vertical" line 20 in generally the same direction as lateral wellbore 104, gravity will typically automatically cause downhole tool 300 to pass through window 128 into liner 122. When it has been determined that main wellbore 102 is truly vertical, or that main wellbore 102 is angled away from "true vertical" line 20 in a direction generally opposite from lateral wellbore 104, deflector 140 is typically deployed into window bushing 126, as described above in connection with FIG. 5.

The following example illustrates the preferred dimensions for wear ring centralizer assembly 200 when assembly 200 is used in connection with a 9⅝ inch, 47 pound main wellbore casing 106; a 7 inch, 29 pound liner 122 for lateral wellbore 104; a 4.5 inch outer diameter production tubing having a minimum, nominal inner diameter for landing nipples above junction 100 of approximately 3.813 inches; and a window bushing 126 having a nominal, outer diameter 400 of approximately 5 inches; a nominal, inner diameter 402 of approximately 4 inches; and a nominal width 404 of window 128 of approximately 3.9 inches. In such a configuration, wear ring centralizers 240 and 242 preferably have an undeformed, outer diameter 260 of approximately 4.04 inches, an axial bore 244 of approximately 3.5 inches, an undeformed gap width "w" (FIG. 7A) of approximately 0.75 inches, an undeformed gap length "1" (FIG. 7A) of approximately 1.62 inches, a height "h" (FIG. 7A) of approximately 1.1 inches, and a wall thickness "t" (FIG. 7A) of approximately 0.54 inches. Wear ring centralizers 240 and 242 are preferably formed from a Beta C or a 6 Al-4 V (6 Aluminum-4 Vanadium) titanium alloy. Wear ring centralizer assembly 200 preferably has a maximum outer diameter 263 of approximately 3.79 inches. When disposed in window bushing 126, wear ring centralizers 240 and 242 preferably have a deformed, outer diameter of approximately 4.02 inches. Of course, different dimensions will be preferred for the various components of wear ring centralizer assembly 200 when assembly 200 is used in connection with different sizes of conventional main wellbore casings and lateral liners, and different sizes of window bushing 126.

It is contemplated that wear ring centralizers 240 and 242 may be modified so as to have a different spring force. Varying the spring force of the wear ring centralizers enables the centralizers to be elastically deformable by different amounts of compressive force, or to have more or less elastic deformation for a given amount of compressive force, for different downhole applications.

For example, the spring force of wear ring centralizers 240 and 242 may be modified by forming the centralizers from materials having a higher or lower modulus of elasticity. Of course, the material selected must also have sufficient strength so that it will not fail during deformation.

Figure 10A:
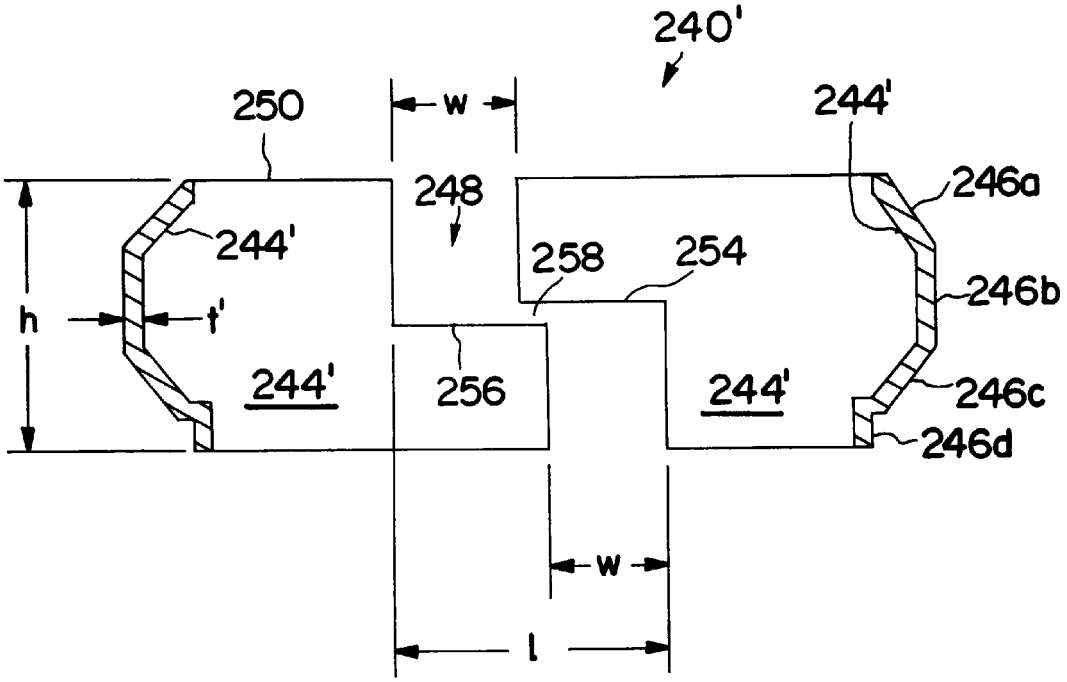
FIG. 10A is an enlarged, schematic, cross-sectional view of an alternate embodiment of the wear ring centralizer of FIGS. 7A and 7B.

As a second example, FIG. 10A shows a wear ring centralizer 240' having a modified geometry that is more easily elastically deformed than wear ring centralizers 240 and 242. Wear ring centralizer 240' preferably has a structure substantially identical to wear ring centralizer 240, with the exception that wear ring centralizer 240' has an axial bore 244' that generally mirrors the geometry of external surface 246. Consequently, wear ring centralizer 240' has a smaller wall thickness "t" than wall thickness "t" of wear ring centralizer 240. Wear ring centralizer 240' is believed to be more debris tolerant than wear ring centralizer 240.

The following example illustrates the preferred dimensions for a wear ring centralizer assembly 200 having at least one wear ring centralizer 240' when such an assembly is used in connection with a 9⅝ inch, 47 pound main wellbore casing 106; a 7 inch, 29 pound liner 122 for lateral wellbore 104; a 4.5 inch outer diameter production tubing having a minimum, nominal inner diameter for landing nipples above junction 100 of approximately 3.813 inches; and a window bushing 126 having a nominal, outer diameter 400 of approximately 5 inches, a nominal, inner diameter 402 of approximately 4 inches, and a nominal width 404 of window 128 of approximately 3.9 inches. In such a configuration, wear ring centralizer 240' preferably has an undeformed, outer diameter 260 of approximately 4.04 inches, an inner diameter of axial bore 244' proximate second flat portion 246*d* of approximately 3.5 inches, an undeformed gap width "w" of approximately 0.75 inches, an undeformed gap length "1" of approximately 1.62 inches, a height "h" of approximately 1.1 inches, and a wall thickness "t" of approximately 0.165 inches. Wear ring centralizer 240' is preferably formed from a Beta C or a 6 Al-4 V titanium alloy. When disposed in window bushing 126, wear ring centralizer 240' preferably has a deformed, outer diameter of approximately 4.02 inches.

Figure 10B:
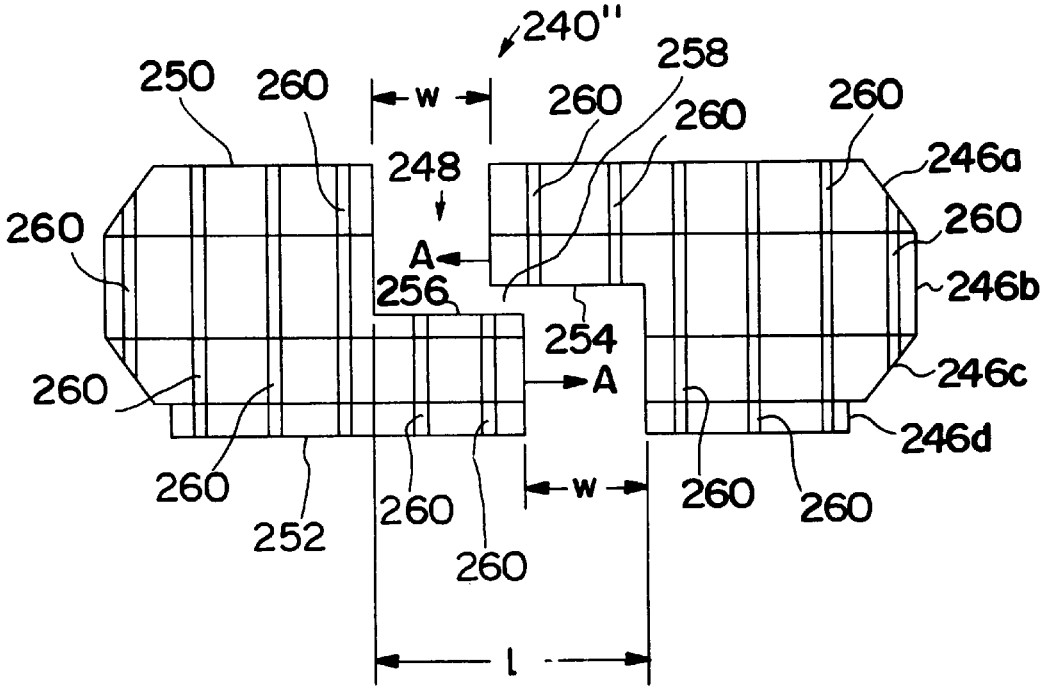
FIG. 10B is an enlarged, schematic, external view of a second alternate embodiment of the wear ring centralizer of FIGS. 7A and 7B.

As a third example, FIG. 10B shows a wear ring centralizer 240" having a modified geometry that is more easily elastically deformed than wear ring centralizers 240 and 242. Wear ring centralizer 240" preferably has a structure substantially identical to wear ring centralizer 240, with the exception that a series of grooves 260, each of which runs from top surface 250 to bottom surface 252, are formed in external surface 246. Grooves 260 do not extend through to axial bore 244 (not shown), and grooves 260 are preferably evenly spaced around the periphery of external surface 246. Although not shown in FIG. 10B, grooves 260 may alternatively be formed on the periphery of axial bore 244. Such alternative grooves 260 do not extend through to external surface 246, and such alternative grooves 260 are preferably evenly spaced around the periphery of axial bore 244.

When a wear ring centralizer assembly 200 having at least one wear ring centralizer 240" is used in connection with a 9⅝ inch, 47 pound main wellbore casing 106; a 7 inch, 29 pound liner 122 for lateral wellbore 104; a 4.5 inch outer diameter production tubing having a minimum, nominal inner diameter for landing nipples above junction 10.0 of approximately 3.813 inches; and a window bushing 126 having a nominal, outer diameter 400 of approximately 5 inches, a nominal, inner diameter 402 of approximately 4 inches, and a nominal width 404 of window 128 of approximately 3.9 inches, assembly 200 and all its various components, including wear ring centralizer 240", preferably have substantially identical dimensions, and preferably use the same materials, as a wear ring centralizer assembly 200 having wear ring centralizers 240 and 242.

Figure 10C:
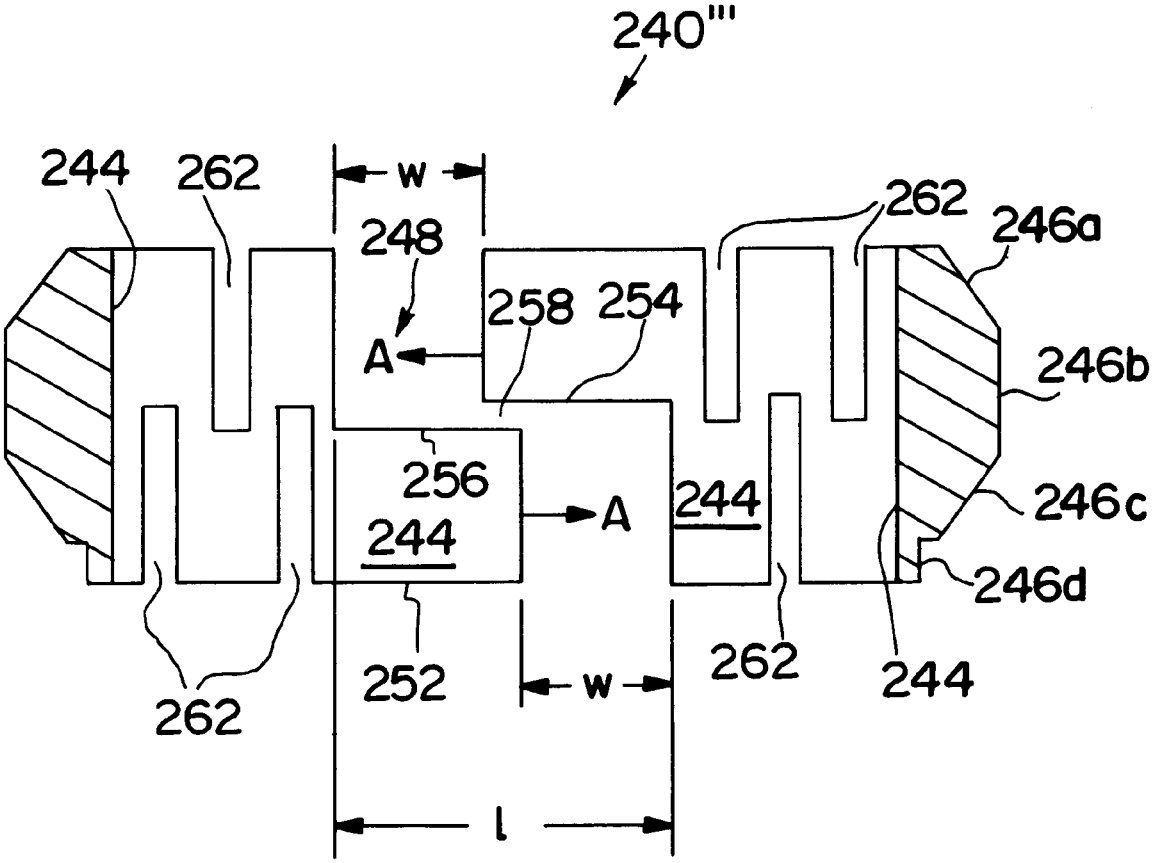
FIG. 10C is an enlarged, schematic, cross-sectional view of a third alternate embodiment of the wear ring centralizer of FIGS. 7A and 7B.

As a fourth example, FIG. 10C shows a wear ring centralizer 240" having a modified geometry that is more easily elastically deformed than wear ring centralizers 240 and 242. Wear ring centralizer 240'" preferably has a structure substantially identical to wear ring centralizer 240, with the exception that centralizer 240'" includes a series of alternating grooves 262. Each of grooves 262 extends vertically from either top surface 250 or bottom surface 252 and preferably terminates proximate a vertical centerline of centralizer 240'". Each of grooves 262 extends radially from external surface 246 to axial bore 244.

When a wear ring centralizer assembly 200 having at least one wear ring centralizer 240'" is used in connection with a 9⅝ inch, 47 pound main wellbore casing 106; a 7 inch, 29 pound liner 122 for lateral wellbore 104; a 4.5 inch outer diameter production tubing having a minimum, nominal inner diameter for landing nipples above junction 100 of approximately 3.813 inches; and a window bushing 126 having a nominal, outer diameter 400 of approximately 5 inches, a nominal, inner diameter 402 of approximately 4 inches; and a nominal width 404 of window 128 of approximately 3.9 inches, assembly 200 and all its various components, including wear ring centralizer 240'", preferably have substantially identical dimensions, and preferably use the same materials, as a wear ring centralizer assembly 200 having wear ring centralizers 240 and 242.

The four examples described above for changing the spring force of wear ring centralizers 240 and 242 are not mutually exclusive. It is contemplated that various combinations of the four examples may be beneficial for specific downhole applications.

Figure 11:
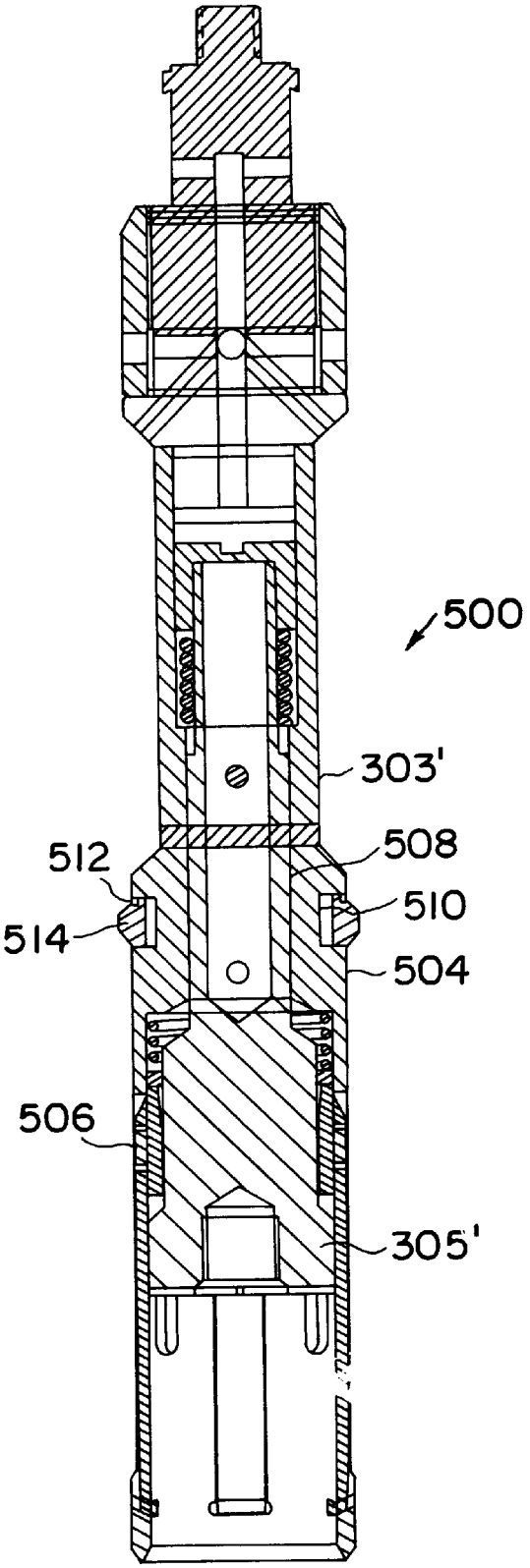
FIG. 11 is a schematic, cross-sectional view of a downhole tool incorporating a wear ring centralizer according to a second preferred embodiment of the present invention.

Referring now to FIG. 11, a downhole tool 500 according to a second preferred embodiment of the present invention is illustrated. As shown in FIG. 11, downhole tool 500 is a wire-line pulling tool typically used for pulling deflectors, plugs, or prongs. The structure of wire-line pulling tool 500 is similar to the structure of the conventional wire-line pulling tool 300 shown in FIG. 8, with several important exceptions.

Middle sub 303' of downhole tool 500 has been modified from middle sub 303 of downhole tool 300 to include a wear ring centralizer retainer 504. Wear ring centralizer retainer 504 is preferably positioned proximate the front, or lower end, 506 of middle sub 303'. Wear ring centralizer retainer 504 includes an axial bore 508 for receiving an elongated pulling piston 305' and an annular recess 510 located on an exterior surface of middle sub 303'. Annular recess 510 preferably has an annular retaining lip 512. A wear ring centralizer 514 is disposed in annular recess 510.

Wear ring centralizer 514 preferably has a substantially identical structure and operation, and is preferably formed from the same materials, as one of wear ring centralizers 240, 240', 240", or 240'", as described hereinabove. As shown in FIG. 11, wear ring centralizer 514 has substantially identical structure, operation, and materials as wear ring centralizer 240. Of course, the various dimensions of wear ring centralizer 514 have been modified so as to be operative with a specific size of downhole tool 500 used in a specific size of window bushing 126.

Referring to FIGS. 4 and 11, downhole tool 500 may be used to navigate through junction 100 of a multilateral well when it is desired that downhole tool 500 not enter liner 122 of lateral wellbore 104 via window 128. As middle sub 303' enters window bushing 126, wear ring centralizer 514 is radially compressed so as to create an interference between the external surface of centralizer 514 and the internal surface of window bushing 126, in a manner substantially similar to that described for wear ring centralizers 240 and 242 of wear ring centralizer assembly 200 hereinabove. Such interference prevents downhole tool 500 from accidentally falling out window 128 into liner 122 due to a dogleg or other protrusion within main wellbore casing 106 above junction 100, or gravitational forces caused by the orientation of main wellbore 102. As middle sub 303' exits from window bushing 126 below junction 100, wear ring centralizer 514 radially expands back to its undeformed diameter. Of course, if it is desired that a downhole tool enter liner 122 of lateral wellbore 104, a conventional downhole tool without wear ring centralizer retainer 504 or wear ring centralizer 514 should be employed.

Although wear ring centralizer retainer 504 is shown in FIG. 11 with only one wear ring centralizer disposed in an annular recess, wear ring centralizer retainer 504 may alternatively employ more than one wear ring centralizer, each disposed in a corresponding annular recess. In addition, although not shown in FIG. 11, downhole tool 500 may be formed by incorporating wear ring centralizer retainer 504 and wear ring centralizer 514 in any conventional downhole tool, such as, for example, a running tool, a pulling tool, or a wire-line tool. Referring to FIG. 5, it is contemplated that downhole tool 500 will be particularly useful in preventing deflector 140 from falling out window 128 into liner 122 during deployment or retrieval of deflector 140.

From the above, one skilled in the art will appreciate that the present invention provides improved, flexible, and dependable navigation of the junctions between a main wellbore and a lateral wellbore in a multilateral well. The present invention provides such improved navigation without inhibiting the amount or rate of well production or increasing the cost or complexity of the completion of the lateral wellbore. The apparatus and methods of the present invention are economical to manufacture and use in a variety of downhole applications.

The present invention is illustrated herein by example, and various modifications may be made by a person of ordinary skill in the art. For example, numerous geometries and/or relative dimensions could be altered to accommodate specific applications of the present invention. As another example, although the present invention has been described in connection with a lateral wellbore completed with a cemented liner, the invention is fully operable with an open hole, or partially open hole, lateral wellbore completion.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A method of navigating a downhole tool through a junction between a main wellbore and a lateral wellbore, the junction comprising a main wellbore casing, and a bushing disposed in the main wellbore casing and having a window proximate the lateral wellbore, the method comprising the steps of:

providing a downhole tool centralizer assembly comprising:

a tubular centralizer retainer having an external surface and an annular recess on the external surface; and an annular spring member disposed within the annular recess, the annular spring member having an outer diameter greater than a predetermined inner diameter of the bushing;

coupling a downhole tool to the downhole tool centralizer assembly;

moving the downhole tool centralizer assembly and the downhole tool through the bushing; and elastically deforming the annular spring member so that the outer diameter of the annular spring member becomes substantially equal to the predetermined inner diameter of the bushing.

2. The method of claim 1 wherein the step of coupling a downhole tool comprises coupling the downhole tool to a front end of the downhole tool centralizer assembly.

3. The method of claim 1 wherein the step of coupling a downhole tool comprises coupling the downhole tool to a rear end of the downhole tool centralizer assembly.

4. The method of claim 1 wherein the step of elastically deforming the annular spring member comprises creating an interference between the annular spring member and the bushing.

5. The method of claim 4, wherein the interference prevents the centralizer assembly from entering the lateral wellbore through the window but allows the downhole tool centralizer assembly to continue moving through the bushing.

6. The method of claim 5, wherein the interference extends around substantially an entire, circular area of potential contact between the annular spring member and the bushing.

7. The method of claim 6 wherein the annular spring member comprises a wear ring centralizer.

8. The method of claim 7 wherein the wear ring centralizer has an axial bore, an external surface, a top surface, and a bottom surface.

9. The method of claim 8 wherein the wear ring centralizer has a gap extending between the top and bottom surfaces of the wear ring centralizer, and between the external surface and the axial bore of the wear ring centralizer.

10. The method of claim 9 wherein the gap creates two slidably mating surfaces, and wherein the mating surfaces overlap when the centralizer is in an undeformed state.

11. The method of claim 10 wherein the external surface has a first flat portion disposed between first and second angled portions, and wherein the axial bore is cylindrical.

12. The method of claim 10 wherein:

the external surface has a first flat portion disposed between first and second angled portions; and the axial bore has a geometry substantially identical to the external surface.

13. The method of claim 11 wherein the external surface comprises a plurality of spaced grooves extending between the top and bottom surfaces of the wear ring centralizer.

14. The method of claim 11 wherein the axial bore comprises a plurality of spaced grooves extending between the top and bottom surfaces of the wear ring centralizer.

15. The method of claim 11 wherein the wear ring centralizer comprises:

a first plurality of spaced grooves extending from the top surface toward a centerline of the wear ring centralizer; and a second plurality of spaced grooves extending from the bottom surface toward a centerline of the wear ring centralizer.

16. The method of claim 15 wherein the first plurality of grooves is spaced in an alternating arrangement with the second plurality of grooves, and wherein the first and second plurality of grooves each extend between the external surface and the axial bore of the wear ring centralizer.

17. The method of claim 1, wherein the tubular centralizer retainer has a second annular recess on the external surface, and further comprising providing a second annular spring member disposed within the annular recess, the second annular spring member having an outer diameter greater than the predetermined inner diameter of the bushing.

18. A method of navigating a downhole tool through a junction between a main wellbore and a lateral wellbore, the junction comprising a main wellbore casing, and a bushing disposed in the main wellbore casing and having a window proximate the lateral wellbore, the method comprising the steps of:

forming the downhole tool with:

a tubular centralizer retainer having an external surface and an annular recess on the external surface; and an annular spring member disposed within the annular recess, the annular spring member having an outer diameter greater than a predetermined inner diameter of the bushing;

moving the downhole tool through the bushing; and elastically deforming the annular spring member so that the outer diameter of the annular spring member becomes substantially equal to the predetermined inner diameter of the bushing.

19. The method of claim 18 wherein the step of elastically deforming the annular spring member comprises creating an interference between the annular spring member and the bushing.

20. The method of claim 19, wherein the interference prevents the downhole tool from entering the lateral wellbore through the window but allows the downhole tool to continue moving through the bushing.

21. The method of claim 20, wherein the interference extends around substantially an entire, circular area of potential contact between the annular spring member and the bushing.

22. The method of claim 21 wherein the annular spring member comprises a wear ring centralizer.

23. The method of claim 22 wherein the wear ring centralizer has an axial bore, an external surface, a top surface, and a bottom surface.

24. The method of claim 23 wherein the wear ring centralizer has a gap extending between the top and bottom surfaces of the wear ring centralizer, and between the external surface and the axial bore of the wear ring centralizer.

25. The method of claim 24 wherein the gap creates two slidably mating surfaces, and wherein the mating surfaces overlap when the centralizer is in an undeformed state.

26. The method of claim 25 wherein the external surface has a first flat portion disposed between first and second angled portions, and wherein the axial bore is cylindrical.

27. The method of claim 25 wherein:

the external surface has a first flat portion disposed between first and second angled portions; and the axial bore has a geometry substantially identical to the external surface.

28. The method of claim 26 wherein the external surface comprises a plurality of spaced grooves extending between the top and bottom surfaces of the wear ring centralizer.

29. The method of claim 26 wherein the axial bore comprises a plurality of spaced grooves extending between the top and bottom surfaces of the wear ring centralizer.

30. The method of claim 26 wherein the wear ring centralizer comprises:

a first plurality of spaced grooves extending from the top surface toward a centerline of the wear ring centralizer; and a second plurality of spaced grooves extending from the bottom surface toward a centerline of the wear ring centralizer.

31. The method of claim 30 wherein the first plurality of grooves is spaced in an alternating arrangement with the second plurality of grooves, and wherein the first and second plurality of grooves each extend between the external surface and the axial bore of the wear ring centralizer.

32. The method of claim 18, wherein the tubular centralizer retainer has a second annular recess on the external surface, and further comprising providing a second annular spring member disposed within the annular recess, the second annular spring member having an outer diameter greater than the predetermined inner diameter of the bushing.

* * * * *